US005819990A

United States Patent [19]

Cimentepe et al.

[11] Patent Number: 5,819,990

[45] Date of Patent: Oct. 13, 1998

[54] DISPENSING PUMP MADE OF PLASTIC FOR PASTE-LIKE MATERIALS

[75] Inventors: Haluk Cimentepe; Günter Auer, both of VS-Villingen, Germany

[73] Assignee: Megaplast Dosiersysteme GmbH, Villingen-Schwenningen, Germany

[21] Appl. No.: 634,420

[22] Filed: Apr. 18, 1996

[30] Foreign Application Priority Data

Apr. 19, 1995 [DE] Germany ..... 295 06 682 U

[51] Int. Cl.[6] ..... B65D 37/00

[52] U.S. Cl. ..... 222/207; 222/321.7; 222/490

[58] Field of Search ..... 222/207, 257, 222/260, 261, 490, 494, 321.7, 383.1, 209

[56] References Cited

U.S. PATENT DOCUMENTS

| | | | |
|---|---|---|---|
| 4,182,496 | 1/1980 | Burke . | |
| 4,438,871 | 3/1984 | Eckert . | |
| 5,152,434 | 10/1992 | Birmelin | 222/257 |
| 5,205,441 | 4/1993 | Andris | 222/207 |
| 5,351,862 | 10/1994 | Weag | 222/209 |

FOREIGN PATENT DOCUMENTS

| | | |
|---|---|---|
| 0 194 417 A3 | 1/1986 | European Pat. Off. . |
| 42 07 800 C1 | 9/1963 | Germany . |
| 30 38 917 A1 | 5/1982 | Germany . |
| 88 00 880 | 7/1989 | Germany . |
| 42 07 800 C1 | 9/1993 | Germany . |

*Primary Examiner*—Philippe Derakshani
*Attorney, Agent, or Firm*—McGlew and Tuttle

[57] ABSTRACT

A dispensing pump made of plastic for dispensing paste-like materials from a paste container. It is provided with a bellows, which connects an upper housing part to a lower housing part. The housing parts are guided telescopically in one another. A paste channel is located within an annular wall. A second hollow body is inserted into the upper housing part, and the second hollow body forms the paste storage space, which is in connection with the paste channel and in which an elastic diaphragm wall having a plug-like closing member is arranged. On a front wall, which extends at right angles to the axis of the discharge opening and forms a limiting side of the paste storage space, the second hollow body has a cylindrical attachment, which projects toward the discharge opening and is concentric to the axis of the discharge opening, with a vent hole, to which attachment a third hollow body, which is made of an elastic plastic and has the diaphragm wall with the plug-like closing member, is attached by a cylindrical wall part made in one piece with the diaphragm wall.

7 Claims, 2 Drawing Sheets

DISPENSING PUMP MADE OF PLASTIC FOR PASTE-LIKE MATERIALS

FIELD OF THE INVENTION

The present invention pertains to a dispensing pump made of plastic for dispensing paste-like materials from a bottles, can- or tube-like paste container with an elastic bellows acting as a pumping member, which is connectingly arranged between a dimensionally stable, upper housing part and a lower, likewise dimensionally stable housing part, which is coaxial thereto and is or can be connected to the paste container, wherein the upper housing part is guided in the lower housing part in a telescopically movable manner, and an upper, cylindrical wall section of the bellows is sealingly in contact with an annular wall stationarily arranged in the upper housing part, within which annular wall a paste channel is located, and wherein a lower end section of the bellows is sealingly in contact with a collar of a radial partition of the lower housing part, wherein, furthermore, a second hollow body is inserted into the upper housing part having a closable discharge opening, wherein the said second hollow body, which forms, together with the upper housing part, a paste storage space, which is located in the immediate vicinity of the discharge opening and is in connection with the paste channel, and an elastic diaphragm wall, which is located opposite the discharge opening, is arranged in the said paste storage space, and the said diaphragm wall has a plug-like closing member that is coaxial to the axis of the discharge opening intersecting the axis of the housing at right angles, and the lower housing part is provided with a suction valve at the said diaphragm wall.

BACKGROUND OF THE INVENTION

A dispensing pump of this type has been known from, e.g., DE 42 07 800 C1. The upper housing part is provided with an intermediate wall in this dispensing pump. A hollow guide body, which is sealingly in contact with the intermediate wall, extends into the hollow space of the hollow body of the upper housing part, wherein the hollow space is located above the intermediate wall and the hollow body is provided with the discharge opening and with a closing front wall. Together with the lateral limiting walls, which are sealingly in contact with or are made in one piece with the inside of the front wall, the guide body defines a paste storage space, which is provided with the discharge opening and is connected to a paste passage opening of the intermediate wall via two paste guide channels. The guide body is provided with an elastic diaphragm wall, which is located opposite the discharge opening and has, in the center of its surface, a plug-like closing member for the discharge opening, which closing member is coaxial to the axis of the discharge opening.

Even though the upper housing part comprises only two individual parts in this prior-art design, they are sometimes so complicated in terms of shape and assembly that a simple, especially mechanized assembly is not possible, because these individual parts must be aligned and fitted together in respective defined angular positions in relation to one another during the assembly. Besides, this prior-art dispensing pump is designed for simultaneously dispensing two paste-like materials, which leads to an additional complication of the individual components in terms of shape. In addition, the hollow body, which is inserted into the upper housing part and with which the diaphragm wall is made in one piece, must have a high dimensional stability and therefore it must consist of a hard plastic, which is detrimental to the elastic functionality of the diaphragm wall.

Another dispensing pump has been known from German Utility Patent No. DE-Gbm No. 88 00 880.0. An intermediate wall of the upper housing part guided telescopically in the lower housing part is provided with a pipe socket, which is directed downward against the partition or the suction valve and is sealingly surrounded by a reinforced collar of the bellows. On its top side, the pipe socket is provided with a conical valve seat annular surface, on which a closing member, which is elastically supported on the closing front wall of the upper, two-part housing part and is guided axially movably in the pipe socket by means of a cross rib, is elastically seated. The upper housing part consists of two hollow bodies, which are lockingly connected to one another, in this case as well, and one of the hollow bodies has a cylindrical guide wall, with which it is guided in the lower housing part axially movably between two limit positions. The second hollow body of the upper housing part, which is lockingly inserted into a projecting cylindrical wall section above the intermediate wall, has an eccentric, channel-like discharge opening, which extends coaxially and is directly in connection with a hollow space, in which the closing member of the discharge valve is arranged, and which is also connected to the interior of the bellows via the said discharge valve, while the upper housing part as a whole moves downward in relation to the lower housing part while performing a delivery stroke.

Automatic closing means are not, in practice, provided for the discharge opening of the movable housing part in this type of dispensing pumps, to which, e.g., the metering pump according to EP-A-0 194 417 also corresponds and which have a bellows as the pumping member.

Paste dispensers with pumps have also been known (U.S. Pat. No. 4,438,871 and DE-OS 30 38 917), in which plug-like closing members for the discharge opening are arranged on elastic diaphragm walls, to which the medium to be discharged is admitted during the working stroke in the direction of the opening. However, these are not pumps which have a bellows as the pumping member. One of the prior-art paste dispensers (U.S. Pat. No. 4,438,871) is provided with two delivery plungers, which can be actuated manually and simultaneously draw in two media from two paste containers, which are located one inside the other but are separated from one another, in cooperation with suction valves, and deliver these media via separate channels into a storage space, which surrounds the closing member and is limited by the diaphragm wall. In the other prior-art paste dispenser (DE-OS 30 38 917), a rod-shaped closing element is fastened to a so-called rolling diaphragm and is arranged in a conical storage space, which is in connection with a paste container via a pipe socket, which is provided with internal threads and is screwed onto a threaded neck of a deformable closing cap. The discharge pressure is brought about in this pump by the axial deformation of the wall of the closing cap or by its downward movement in the axial direction, and the container is provided with a follower plunger, which follows the movement during each restoring movement of the closing cap.

SUMMARY AND OBJECTS OF THE INVENTION

The basic object of the present invention is to provide a dispensing pump of the type noted above from individual parts which can be prepared in the simplest possible manner and can be assembled in a mechanical manner, with a functionally reliable closing means for the discharge opening of the upper housing part, and at the same time to form a paste storage space of the smallest possible volume.

This object is attained according to the present invention by the second hollow body being formed of dimensionally stable plastic having a cylindrical attachment, which projects toward the discharge opening and is concentric to the axis of the discharge opening, with a vent hole, at a front wall which extends at right angles to the axis of the discharge opening and forms a limiting side of the paste storage space, wherein a third hollow body made of an elastic plastic, which has the diaphragm wall with the plug-like closing member, is attached to the attachment by means of a cylindrical wall part made integrally in one piece with the diaphragm wall.

Even though the present invention is described as a dispensing pump for a paste dispenser in the patent claims for the sake of easier understanding, it can also be used to dispense liquid materials, even in connection with an atomizer nozzle.

Such a dispensing pump, which has a bellows formed of an injection-molded part as the pumping member, can be assembled mechanically on an assembly line with relatively simple assembly devices, because practically all parts can be fitted together coaxially.

Another significant advantage of the solution according to the present invention is the fact that the paste storage space can be designed to be such that its uptake volume and consequently the residual amount of the medium remaining in it can be kept as small as possible, but, on the other hand, the diaphragm surface, which has to have a certain size for satisfactory opening and closing, can be designed in an optimal manner.

The possibility of checking both the pumping function of the bellows and the closing and opening function of the closing member of the discharge opening under dry conditions, i.e., without the medium which the dispensing pump is designed to dispense, on an automatic assembly machine mechanically and yet practically at no cost, can also be considered to be another advantageous aspect.

The interior space of the bellows is preferably connected to the paste storage space through a central paste channel. The central paste channel is preferably formed partly by the tube section of the second hollow body which tube section is coaxial to the housing axis, and partly by a central sleeve of the fourth hollow body. The sleeve sealingly accommodates the lower end of the tube section and the fourth hollow body has the annular wall surrounded by the upper wall section of the bellows. The fourth hollow body preferably has a cylindrical attachment which axially extends into the bellows and with which the annular wall and the lower front wall provided with the sleeve are made in one piece. A second hollow body is provided on the inside with a plurality of axially extending centering ribs which centeringly accommodate the upper wall section of the bellows with an at least weak, radial clamping action. The fourth hollow body has a radially outwardly projecting collar at the top end of its annular wall. At least some of the centering ribs preferably have radial stop shoulders for the top edge of the fourth hollow body. The second hollow body is preferably provided with a front-side wedge shaped depression which is engaged by an aligning wedge made in one piece with the inside of the cover wall of the upper housing part in a positive-locking manner.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
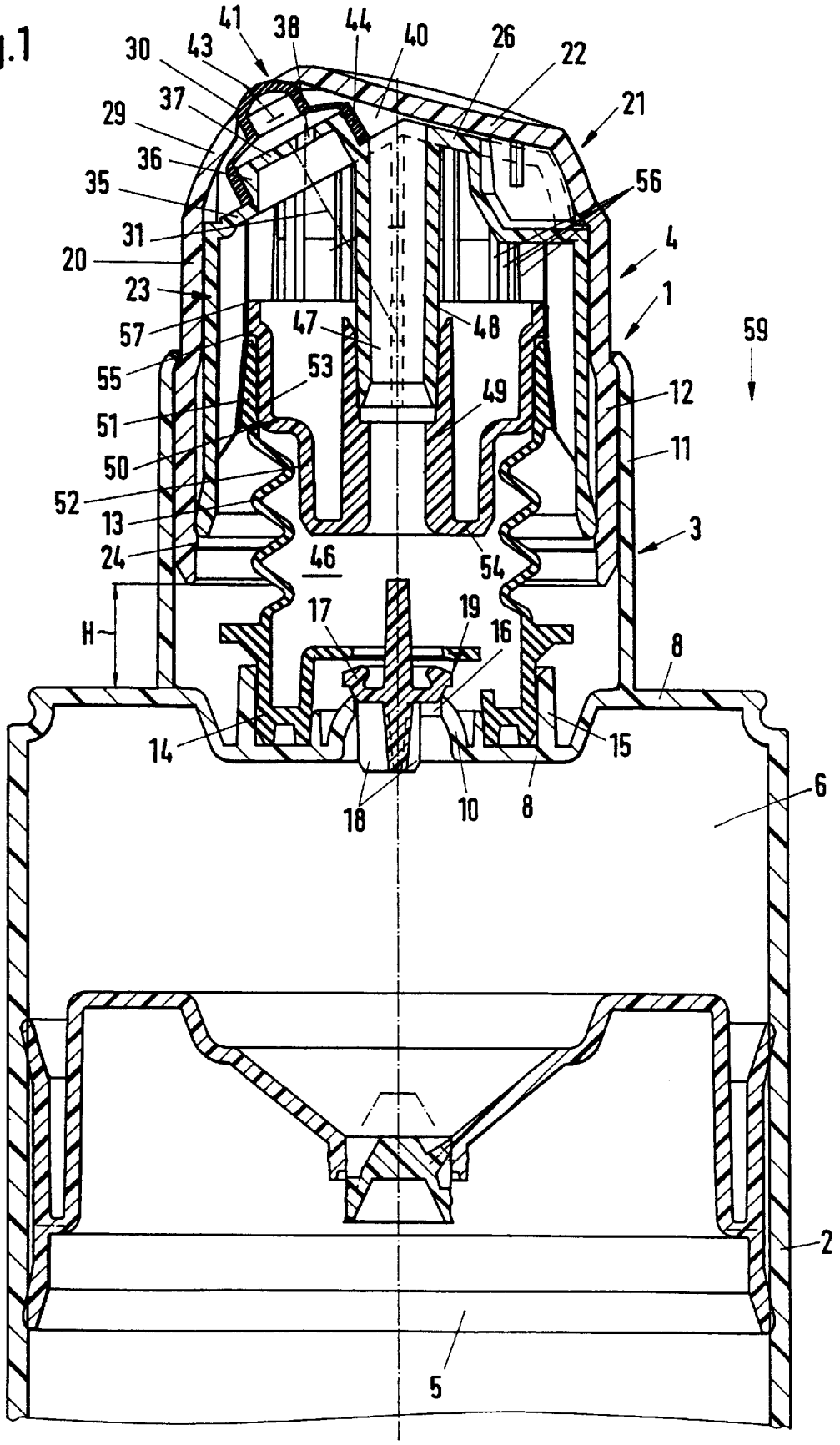
FIG. 1 is a sectional view of a paste dispenser with the dispensing pump of the type according to the present invention.
Figure 2:
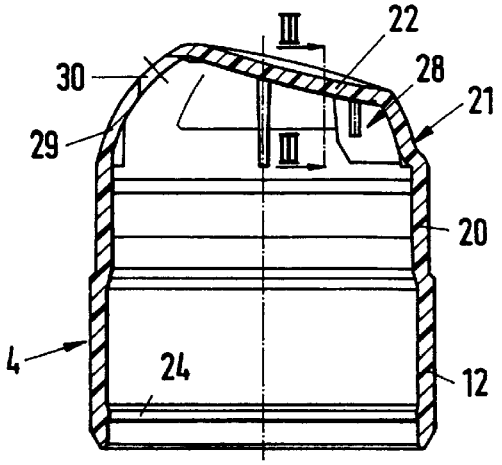
FIG. 2 is a sectional view of the upper housing part.
Figure 3:
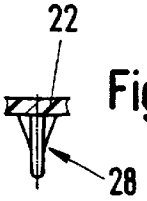
FIG. 3 is a sectional view taken along line III—III from FIG. 2.
Figure 4:
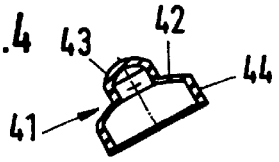
FIG. 4 is a sectional view of a closing member of the discharge opening, which closing member is provided with the diaphragm wall.
Figure 7:
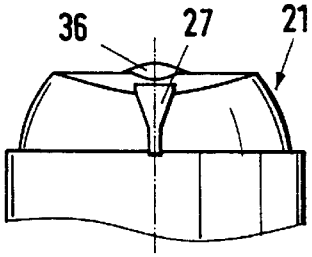
FIG. 7 is a view VII from FIG. 5.
Figure 5:
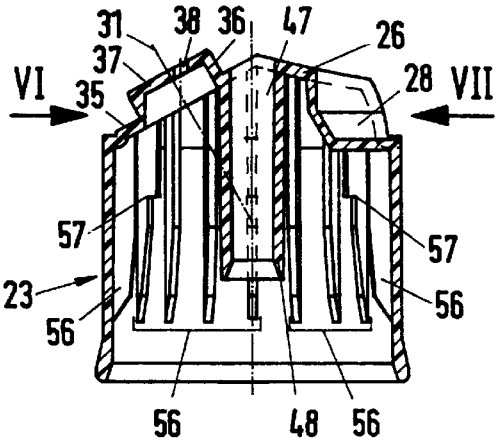
FIG. 5 is a sectional view of the second hollow body as an individual part.
Figure 6:
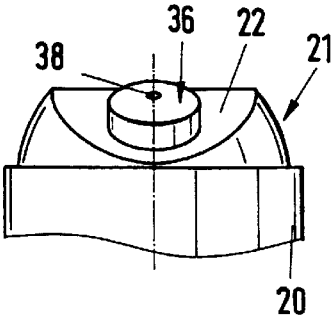
FIG. 6 is a view VI from FIG. 5.
Figure 8:
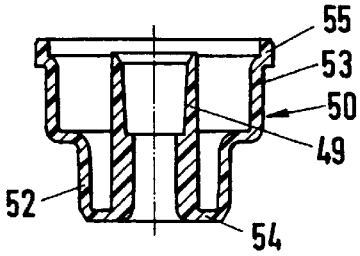
FIG. 8 is a sectional view of the fourth hollow body.
Figure 9:
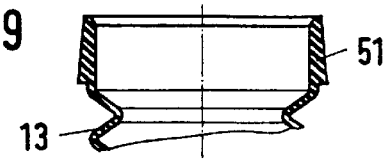
FIG. 9 is the upper end section of the bellows.

The paste dispenser showed as an exemplary embodiment in the drawings has a cylindrical cross-sectional shape. However, the embodiment according to the present invention may also just as well be embodied with an oval or another cross-sectional shape.

The paste dispenser which is shown not quite completely in a sectional view in FIG. 1 has a dispensing pump 1 as the top part and a paste container 2 as the bottom part, which is made as a cylindrical hollow body in one part with a cylindrical lower housing part 3 and is provided with a follower plunger 5 in the known manner. The interior space 6 of the paste container 2 is separated from the interior space 7 of the lower housing part 3 by a radial partition 8, with which an upwardly directed, round collar 10, which is arranged concentrically to the common longitudinal housing axis 9, is made in one piece.

An upper housing part 4 is telescopically guided in a cylindrical outer wall 11 of the lower housing part 3 by means of a likewise cylindrical guide wall 12. This housing part 4, which is designed as an essentially cylindrical hollow body, is movable by an axial stroke H in the outer wall 11.

A coaxial bellows 13, which is connected to the lower housing part 3 or to its partition 8, is used as the pumping member. The lower cylindrical end section 14 of the bellows 3 is sealingly seated in an upwardly directed collar 15 of the partition 8. The collar 10 is provided with a central passage opening 16, whose edge is designed as an annular valve seat surface for a disk-shaped valve-closing member 17, which is provided with at least three radial guide ribs 18, which are axially movably guided in the passage opening. The valve-closing member 17, which is secured against falling out by a circlip, which is arranged above it and is injection-molded in one piece with the lower part of the bellows 13, forms the suction valve 19 of the dispensing pump 1 in cooperation with the collar 10.

Above the guide wall 12, which is open at the bottom, the upper housing part 4 of the dispensing pump 1 has a radially somewhat offset middle, likewise cylindrical wall part 20, which is joined by a likewise radially offset head part 21 with an oblique, slightly concave cover wall 22. A discharge opening 30, whose axis 31 intersects the housing discharge axis 9 at an acute angle $\alpha$ of about 30°, is arranged in a rounded wall section 29, which extends from the top edge of the middle wall part 20 to the cover wall 22.

A second hollow body 23 is inserted into the hollow space of the upper housing part 4; this second hollow body 23 is axially supported with its lower edge on an only slightly contacting inner annular rib 24 of the guide wall 12 in order to be thus arranged in the housing part 4 in a firmly seated manner.

This second hollow body 23 has a cylindrical wall section 25, which is sealingly surrounded by the middle wall part 20 of the housing part 4. A front wall part 26, which is sealingly in contact with the inner surface of the cover wall 22, is provided with a radially extending, wedge-shaped depression 27, which is engaged in a positive-locking manner by an aligning wedge 28, which is made in one piece with the inside of the cover wall 22. These two elements act as assembly aids.

A flat front wall 35, which extends at right angles to the axis 31 of the discharge opening and is provided with a cylindrical attachment 36 projecting against the discharge opening 30, extends from the front wall part 26 to the cylindrical wall section of the second hollow body 23. This attachment 36 has, in turn, a front wall 37 with a vent hole 38.

The front wall part 26 forms one limiting side of a paste storage space 40, which is otherwise limited by the wall section 29 and the cover wall 22, and with which the discharge opening 30 is associated. This discharge opening can be closed and is closed in the nonactuated, released, normal position of the upper housing part by a closing member 41, which forms a third hollow body made of an elastic plastic and has an annular diaphragm wall 42, which is elastic in the direction of axis 31, with a round-headed, plug- or nipple-like closing part 43 and with a cylindrical wall part 44. The diaphragm wall 42, whose cylindrical wall part 44 surrounds the jacket surface of the attachment 36 in the assembled state, is located at a certain axial distance from the front wall 37 of the cylindrical attachment 36 and is preferably slightly conical to be able to reliably perform the axial movements necessary for the opening and closing of the discharge opening 30 by the closing part 43.

The paste storage space 40 having the smallest possible volume is in connection with the interior space of the bellows 13 through a central paste channel 47, which is formed partly by a tube section 48 of the second hollow body 23, which tube section is coaxial to the housing axis 9, and partly by a central sleeve 49 of a fourth hollow body 50 made of a dimensionally stable plastic, which said sleeve sealingly accommodates the lower end of the said tube section 48. This fourth hollow body 50 has an annular wall 53, which is surrounded by an upper, essentially cylindrical wall section 51 of the bellows 13. In addition, the fourth hollow body 50 is provided with a cylindrical attachment 52 of smaller diameter, which extends into the bellows 13 and with which the annular wall 52 and a lower front wall 54 provided with the sleeve 49 is made in one piece. At the top end, the annular wall 53 has a radially outwardly projecting collar 55.

To achieve an at least weakly clamping accommodation of the annular wall 53, which is provided with the collar 55 and is surrounded by the upper wall section 51 of the bellows 13, the second hollow body 23 is provided on the inside with a plurality of axially extending centering ribs 56. At least some of the centering ribs 56 have radial stop shoulders 57 for the top edge of the fourth hollow body 50.

Since the fitted-together individual parts, i.e., the three hollow bodies 4, 23 and 50, consist of round, rotationally symmetrical parts, which are fitted together by being pushed axially into each other in the dispensing pump 1 described here, their assembly can be carried out mechanically without difficulty, and the edges which come into contact with each other may be shaped conically to facilitate this process.

The mode of operation of the dispensing pump described is very simple and therefore also highly reliable. Assuming that the bellows 13, the paste channel 47, and the paste storage space have been filled with the paste-like or liquid material to be dispensed as a result of one or more preceding pump strokes of the upper housing part 4, the diaphragm wall 42 with its closing part 43 is moved in the inward direction during the next pump stroke, which is performed by the upper housing part 4 being pressed down manually in the direction of arrow 59, due to the overpressure generated in the paste storage space, and the discharge opening 30 is opened. Depending on whether or not the full pump stroke has been performed, a certain amount of the material is discharged through the discharge opening 30. Pressure equalization takes place with the interior space of the hollow body 23 during the axial movements of the diaphragm wall 42 in its hollow space through the vent hole 38, and the interior space of the hollow body 23 is in turn in connection with the free atmosphere through a small air gap between the guide wall 12 and the outer wall 11.

As soon as the actuated housing part 4 is again released, it returns, driven by the elastic restoring force of the bellows 13, into its starting position shown in FIG. 1. A vacuum is generated now in the paste storage space, and this vacuum leads to the immediate closure of the discharge opening 30 by the closing part 43 fastened to the diaphragm wall 42, and to more material being drawn in from the paste container 2 by the suction valve 19.

While a specific embodiment of the invention has been shown and described in detail to illustrate the application of the principles of the invention, it will be understood that the invention may be embodied otherwise without departing from such principles.

What is claimed is:

1. Dispensing pump made of plastic for dispensing paste-like materials from a paste container, the dispensing pump comprising:

a dimensionally stable, upper housing part with an annular wall forming a stationary part;

a dimensionally stable lower housing part, which is coaxial to said upper housing part and can be connected to the paste container;

an elastic bellows acting as a pumping member, said elastic bellows being connectingly arranged between said upper housing part and said lower housing part, wherein said upper housing part is telescopically movably guided in said lower housing part, said bellows having an upper, cylindrical wall section which is sealingly in contact with said annular wall, a paste channel being located within said annular wall, said bellows having a lower end section sealingly in contact with a collar of a radial partition of the lower housing part;

a hollow body inserted into said upper housing part, said hollow body having a closable discharge opening, said hollow body cooperating with said upper housing part to form a paste storage space, said paste storage space being located in the immediate vicinity of the discharge opening and being in connection with said paste channel, said hollow body being formed of a dimensionally stable plastic and having a front wall which extends at right angles to a discharge axis of the said discharge opening and forms a limiting side of the said paste storage space, a cylindrical attachment with a vent hole, said cylindrical attachment being concentric to said discharge axis of said discharge opening; and an additional hollow body made of an elastic plastic, which includes a diaphragm wall with a plug-like closing part attached to said cylindrical attachment by means of a cylindrical wall part made in one piece with said diaphragm wall, said plug-like closing member intersecting a longitudinal housing axis at an acute angle and being coaxial to a discharge opening, and said lower housing part being provided with a suction valve at said diaphragm wall.

2. A dispensing pump according to claim 1, said bellows defines an interior space connected to said paste storage space through a central paste channel, said central paste channel being formed partly by a tube section of said second hollow body, said tube section being coaxial to said longitudinal housing axis, said central paste channel being also partly formed by a central sleeve of a further hollow body, said further hollow body being formed of a dimensionally stable plastic, said central sleeve sealingly accommodating a lower end of said tube section, said further hollow body having an annular wall surrounded by an upper wall section of said bellows.

3. A dispensing pump according to claim 1, wherein said further hollow body includes a cylindrical attachment which axially extends into said bellows and with which said annular wall and a lower front wall provided with said sleeve are made in one piece.

4. A dispensing pump according to claim 2, wherein said hollow body is provided on an inside with a plurality of axially extending centering webs which centeringly accommodate said upper wall section of said bellows with at least weak radial clamping action.

5. A dispensing pump according to claim 3, wherein said further hollow body has a radially outwardly projecting collar at a top end of said annular wall.

6. A dispensing pump according to claim 4, wherein at least some of said centering ribs include radial stop shoulders for a top edge of said further hollow body.

7. A dispensing pump according to claim 1, wherein said additional hollow body is provided with a front side, wedge shaped depression, which is engaged by an aligning wedge formed in one piece with an inside of said cover wall of said upper housing part, in a positive locking manner.

* * * * *